US010032549B2

(12) United States Patent
Batz et al.

(10) Patent No.: US 10,032,549 B2
(45) Date of Patent: Jul. 24, 2018

(54) SUPERCONDUCTING COIL DEVICE WITH COIL WINDING AND PRODUCTION METHOD

(71) Applicant: Siemens Aktiengesellschaft, Munich (DE)

(72) Inventors: Otto Batz, Leutenbach (DE); Werner Herkert, Erlangen (DE); Anne Kuhnert, Fuerth (DE); Peter Kummeth, Herzogenaurach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 238 days.

(21) Appl. No.: 14/888,813

(22) PCT Filed: May 20, 2014

(86) PCT No.: PCT/EP2014/060284
§ 371 (c)(1),
(2) Date: Nov. 3, 2015

(87) PCT Pub. No.: WO2014/191252
PCT Pub. Date: Dec. 4, 2014

(65) Prior Publication Data

US 2016/0118172 A1 Apr. 28, 2016

(30) Foreign Application Priority Data

May 28, 2013 (DE) ..... 10 2013 209 967

(51) Int. Cl.
*H01F 6/06* (2006.01)
*H01F 41/04* (2006.01)
*H01F 41/07* (2016.01)

(52) U.S. Cl.
CPC ..... *H01F 6/06* (2013.01); *H01F 41/048* (2013.01); *H01F 41/07* (2016.01)

(58) Field of Classification Search
CPC ..... H01F 6/00–6/06; H01F 41/00–41/07
See application file for complete search history.

(56) References Cited

U.S. PATENT DOCUMENTS 5,387,891 A * 2/1995 Nick ..... H01F 6/06 335/216
7,566,684 B1 7/2009 Levin et al. ..... 505/430
(Continued)

FOREIGN PATENT DOCUMENTS

CN 101512688 A 8/2009 ..... H01F 41/04
DE 102012223366 A1 6/2014 ..... H01B 12/06
(Continued)

OTHER PUBLICATIONS

Korean Notice of Allowance, Application No. 20157036564, 3 pages, dated Jul. 5, 2017.

*Primary Examiner* — Colleen P Dunn
(74) *Attorney, Agent, or Firm* — Slayden Grubert Beard PLLC

(57) ABSTRACT

A superconducting coil device includes a superconducting flat conductor having one or more torsional turns. The flat conductor is wound around a winding support to define multiple turns of the conductor around the support. In at least one of the turns, the flat conductor is twisted through approximately 180 degrees about a longitudinal axis of the flat conductor, to thereby switch a contact side of the flat conductor from radially inwardly facing to radially outwardly facing, or vice versa. The contact side of the flat conductor at an inner turn faces a center of the winding and, and at an outer turn faces away from the center of the winding. The inwardly-facing contact side of the strip at an inner turn may be coupled to an inner contact element, and the outwardly-facing contact side at an outer turn may be conductively coupled to an outer contact element.

11 Claims, 2 Drawing Sheets

(56) References Cited

U.S. PATENT DOCUMENTS

| | | | | |
|---|---|---|---|---|
| 8,260,386 | B2 | 9/2012 | Herkert et al. | 505/150 |
| 2004/0122638 | A1 | 6/2004 | Niemann et al. | 703/2 |
| 2007/0056158 | A1 | 3/2007 | Lee et al. | 29/599 |
| 2009/0083967 | A1* | 4/2009 | Meinke | G01R 33/34007 29/602.1 |
| 2009/0251257 | A1 | 10/2009 | Stelzer et al. | 335/300 |
| 2009/0251269 | A1 | 10/2009 | Stelzer et al. | 336/208 |
| 2009/0251270 | A1 | 10/2009 | Meinke et al. | 336/208 |
| 2015/0318099 | A1 | 11/2015 | Frank et al. | H01F 6/06 |

FOREIGN PATENT DOCUMENTS

| | | | | |
|---|---|---|---|---|
| EP | 0718898 | A1 | 6/1996 | C22F 1/00 |
| EP | 2477317 | A1 | 7/2012 | H02K 3/47 |
| GB | 2294592 | A | 5/1996 | H01F 41/04 |
| JP | 025572 | A | 1/1990 | H01L 29/78 |
| JP | 0396015 | U | 10/1991 | H01F 30/00 |
| JP | 06510885 | A | 12/1994 | H01F 6/06 |
| JP | 08172013 | A | 7/1996 | H01F 41/06 |
| JP | 08227621 | A | 9/1996 | C22F 1/00 |
| JP | 08298208 | A | 11/1996 | H01F 6/06 |
| JP | 2006324716 | A | 11/2006 | H04M 1/00 |
| JP | 2008140930 | A | 6/2008 | H01F 6/06 |
| WO | 2009/124031 | A1 | 10/2009 | G01R 33/3815 |
| WO | 2014/191252 | A1 | 12/2014 | H01F 41/04 |

* cited by examiner

SUPERCONDUCTING COIL DEVICE WITH COIL WINDING AND PRODUCTION METHOD

CROSS-REFERENCE TO RELATED APPLICATIONS

This application is a U.S. National Stage Application of International Application No. PCT/EP2014/060284 filed May 20, 2014, which designates the United States of America, and claims priority to DE Application No. 10 2013 209 967.3 filed May 28, 2013, the contents of which are hereby incorporated by reference in their entirety.

TECHNICAL FIELD

The present invention relates to a superconducting coil device with at least one coil winding with multiple turns of a superconducting strip conductor. The invention also relates to a production method for such a superconducting coil device.

BACKGROUND

In the area of superconducting machines and superconducting magnetic coils, there are known coil devices in which superconducting wires or strip conductors are wound in coil windings. For classic low-temperature superconductors such as NbTi and $Nb_3Sn$, usually conductors in the form of wire are used. On the other hand, the high-temperature superconductors, or high-Tc superconductors (HTS), are superconducting materials with a transition temperature above 25 K and, in the case of some classes of material, above 77 K. These HTS conductors typically take the form of flat strip conductors, which have a strip-form substrate strip and a superconducting layer arranged on the substrate strip.

In addition, the strip conductors often also have further layers, such as stabilizing layers, contact layers, buffer layers and in some cases also insulating layers. The most important class of material of the so-called HTS conductors of the second generation (2G-HTS) are compounds of the type $REBa_2Cu_3O_x$, where RE stands for an element of the rare earths or a mixture of such elements.

The substrate strip may be formed from steel or of the alloy Hastelloy. The electrical contact with an external circuit is usually established by way of a contact layer of copper, this contact layer either being applied on one side over the superconducting layer or being able to surround the entire strip conductor as an enclosing layer. In both configurations, it is more favorable to establish the contact on the side of the substrate strip that carries the superconducting layer. This side of the strip conductor is referred to hereinafter as the contact side. With contacting on the rear side, that is to say on the side of the substrate facing away from the superconducting layer, higher contact resistances occur, which leads to greater electrical losses and a considerable need for cooling in these regions.

In the case of a superconducting coil winding in which multiple layers of a strip conductor come to lie one on top of the other in multiple turns, it is often difficult to contact both ends of the coil winding on the contact side. With winding techniques that are used as standard for producing disk windings, the contact side of the strip conductor will usually come to lie on the inside either on the inner side or on the outer side of the winding. In order nevertheless to create a low-resistance contact on the contact side of the strip conductor, in the case of known coil devices a specially designed contact piece is used and is inserted into the winding next to the contact side of the strip conductor. However, a complex production process is necessary for such a coil device since special measures have to be taken at the location of this contact piece to ensure the necessary mechanical stability. If a wet winding process with an epoxy adhesive is used, then a packing block, for example of Teflon, must first be inserted in order to keep the location that is to be contacted free from adhesive. After removing the packing block, a soldered connection with a contact piece of copper may be produced for example for the contacting of this location. Since, however, this contact lies within the winding, to produce the necessary mechanical stability the contact region must subsequently be fixed with binding bands of glass-fiber-reinforced plastic and epoxy adhesive.

The German application 102012223366.0, which is not a prior publication, discloses a superconducting coil winding with at least two strip conductors, which respectively have a contact side. Within a coil winding of the coil device, the first and second strip conductors are electrically connected by way of an inner contact between their contact sides. The first and second strip conductors differ in terms of their orientation with respect to the center of the coil, so that this inner contact has the effect that the orientation of the contact side is turned. This makes freely accessible contacting of the contact side possible both on the inner side and on the outer side of the coil winding. The disadvantage of the coil winding disclosed there is, however, that the additional inner contact has the effect of creating a further normally conducting connection within the coil, and therefore the superconducting properties of the coil are interrupted in its interior, and electrical losses occur there together with a greater development of heat.

SUMMARY

One embodiment provides a superconducting coil device with at least one coil winding, comprising at least one turn of at least one superconducting strip conductor, which has a first conductor surface, which is formed as the contact side and is provided with a contact layer, wherein the strip conductor is twisted within at least one turn in a torsion region by approximately 180 degrees about a longitudinal axis of the strip conductor, and wherein the contact side of the strip conductor is facing a center of the winding on an inner side of the winding and is facing away from the center of the winding on an outer side of the winding.

In a further embodiment, the superconducting coil device includes a first contact between the contact side of the strip conductor and an inner contact piece on an inner side of the coil winding and a second contact between the contact side of the strip conductor and an outer contact piece on an outer side of the coil winding for connecting the coil device to an external circuit.

In a further embodiment, the strip conductor has two conductor surfaces and the coil device comprising at least two packing blocks, which are arranged respectively adjacent one of the conductor surfaces of the strip conductor in the torsion region of the at least one twisted turn, so that they largely fill interspaces between adjacent turns that are caused by the torsion.

In a further embodiment, each of the two packing blocks comprises an inner and an outer section, the respective inner section being arranged on a side of the twisted strip conductor that is locally facing the center and the respective outer section being arranged on a side of the twisted strip conductor that is locally facing away from the center.

In a further embodiment, the torsion region is at least three times as great as a width of the strip conductor along a longitudinal direction of the strip conductor.

In a further embodiment, the torsion region of the twisted turn lies approximately diametrically opposite the region of the first contact.

In a further embodiment, the coil winding is formed as a planar rectangular coil with four straight portions and four rounded corners.

In a further embodiment, the torsion region is arranged centrally on one of the straight portions of the rectangular coil.

In a further embodiment, the turns of the coil winding are mechanically fixed with a casting compound and/or an adhesive.

Another embodiment provides a method for producing a superconducting coil device with at least one coil winding, wherein a superconducting strip conductor is wound in multiple turns onto a winding support, the strip conductor having a first conductor surface, which is formed as the contact side and is provided with a contact layer, wherein the contact side of the strip conductor is facing the winding support, and consequently a center of the winding, at the beginning of the winding, wherein the strip conductor is twisted within at least one of the turns in a torsion region by approximately 180 degrees about a longitudinal axis of the strip conductor, and wherein the contact side of the strip conductor is facing away from the center of the winding on an outer side of the winding.

In a further embodiment, a first contact between the contact side of the strip conductor and an inner contact piece is formed before the winding of the strip conductor and in which a second contact between the contact side of the strip conductor and an outer contact piece is formed after the winding of the strip conductor for connecting the coil device to an external circuit.

In a further embodiment, a first contact between the contact side of the strip conductor and an inner contact piece and a second contact between the contact side of the strip conductor and an outer contact piece are formed after the winding of the strip conductor.

In a further embodiment, in the torsion region of the at least one twisted turn, at least two packing blocks are arranged respectively adjacent one of two conductor surfaces of the strip conductor in such a way that they fill interspaces between adjacent turns that are caused by the torsion.

In a further embodiment, each of the two packing blocks comprises an inner and an outer section, the respective inner section being arranged on a side of the twisted strip conductor that is locally facing the center and the respective outer section being arranged on a side of the twisted strip conductor that is locally facing away from the center.

In a further embodiment, the coil winding is cast with a casting compound and/or adhesively bonded with an adhesive after the winding and/or during the winding.

BRIEF DESCRIPTION OF THE DRAWINGS

Embodiments of the invention are described below with reference to the drawings, in which.

DETAILED DESCRIPTION

Figure 1:
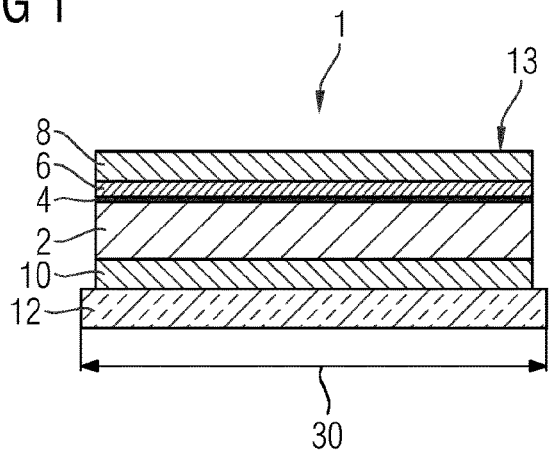
FIG. 1 shows a schematic cross section of a superconducting strip conductor.

Embodiments of the present invention provide a coil device and a method for producing a coil device.

In some embodiments, the coil device comprises at least one coil winding with at least one turn of at least one superconducting strip conductor. The strip conductor has a first conductor surface, which is formed as the contact side and is provided with a contact layer. The strip conductor is twisted within at least one turn in a torsion region by approximately 180 degrees about a longitudinal axis of the strip conductor, and the contact side of the strip conductor is facing a center of the winding on an inner side of the winding and is facing away from the center of the winding on an outer side of the winding.

The torsion of the strip conductor about its longitudinal axis within the coil winding achieves the effect that, in the case of a single winding typically comprising a plurality of turns lying flat one on top of the other, the side of the strip conductor with the lower-resistance contact with respect to the superconducting layer comes to lie toward the outside both on the inner side of the winding and on the outer side of the winding. Usually, an unnecessary additional torsion within the winding of a superconducting strip conductor tends to be avoided since such a torsion can cause internal stresses of the layer material, to the extent that there is delamination and loss of the superconducting properties. It has been found, however, that the development of novel strip conductor materials, in particular the further development of high-temperature superconductor materials of the second generation, has led to strip conductors that are much more flexible than earlier conductor structures. The superconducting coil device may therefore expediently comprise HTS materials of the second generation, in particular the aforementioned compounds of the type $REBa_2Cu_3O_x$. HTS materials of the second generation are also advantageous since they have a higher tensile strength and also a higher critical current density than HTS materials of the first generation.

One advantage in comparison with the solution disclosed in 102012223366.0 is that no additional normally conducting soldered location has to be introduced into the winding. This makes the production of the coil winding less complex, and the electrical losses caused by the soldered location, and the associated additional development of heat within the coil winding, are avoided. The overall coil winding may be formed with either one or more parallel-lying superconducting conductor tracks, which may extend over the entire radial region of the coil winding. In the case of the use of a stack of multiple parallel-lying strip conductors, the individual strip conductors of the stack may either be twisted individually one after the other or they may be twisted as a whole in the form of the entire stack.

Furthermore, mechanical problems associated with an additional soldered location can be avoided. For example, buckling of the strip conductor within the winding can be avoided, and the durability of the overall superconducting coil device is not put at risk by the possible wearing of an additional inner soldered location.

The coil device according to the invention advantageously comprises a coil winding with a plurality of turns, but there are also possible applications in which the advantage according to the invention of the torsion of the strip conductor already comes into effect with a single turn.

In the case of the method according to the invention for producing a superconducting coil device with at least one coil winding, a superconducting strip conductor is wound in multiple turns onto a winding support. The strip conductor has a first conductor surface, which is formed as the contact side and is provided with a contact layer. The contact side of the strip conductor is in this case facing the winding support, and consequently a center of the winding, at the beginning of the winding. The strip conductor is twisted within at least one of the turns in a torsion region by approximately 180 degrees about a longitudinal axis of the strip conductor, and the contact side of the strip conductor is facing away from the center of the winding on an outer side of the winding.

The advantages of the production method are partly analogous to the advantages of the superconducting coil device according to the invention. Further advantages lie in the simplified production process in comparison with the production of a coil device with an additional inner contact for changing the orientation of the strip conductor. With a turning of the strip conductor by torsion, on the one hand the additional process step for producing the inner contact connection is avoided. On the other hand, the winding can be performed with a higher winding tension if there is no mechanically sensitive inner soldered contact. The winding process can generally also be performed more easily and quickly if only a single strip conductor or a pack of parallel-lying strip conductors without an additional inner soldered contact is to be wound. Above all, the winding process is easier because, without an inner soldered contact, no additional preparatory process steps are necessary. In particular, no additional rewinding steps are necessary on a stock reel for providing the strip conductor to be wound or the pack of multiple strip conductors to be wound.

The superconducting coil device may comprise a first contact between the contact side of the strip conductor and an inner contact piece on an inner side of the coil winding and a second contact between the contact side of the strip conductor and an outer contact piece on an outer side of the coil winding. Here, the inner side of the coil winding is facing a center of the coil winding, and the outer side of the coil winding is facing away from the center of the coil winding. The first and second contacts with the inner and outer contact pieces serve for connecting the coil device to an external circuit. These contacts are expediently meant to be of the lowest possible resistance, and the contact pieces expediently comprise materials that are as conductive as possible, with a great geometrical cross section for transporting current. For example, the inner and outer contact pieces may comprise copper. The advantage of this embodiment is that in this way the contacts with the two contact pieces can be created on freely accessible sides of the coil winding. By contrast with the prior art, no temporary packing blocks have to be inserted into the winding when producing the coil winding and then subsequently removed again from there in order to make space for a contact piece to be introduced into an interspace of the winding. This dispenses with the need for the great space requirement for such a placeholder and similarly the space requirement for a contact piece within the winding. This leads to a higher effective current density within the winding. It also avoids putting at risk the mechanical stability of the coil by mechanically removing the placeholder and subsequently inserting a contact piece under the winding. Furthermore, there is also no need for the mechanical loading that may be caused by the different thermal shrinkage between the material of the placeholder and the other materials of the coil winding when the coil winding is cooling down to operating temperature.

A further advantage of the freely accessible contact locations for creating the contacts with the contact pieces is that under less confined space conditions a sufficiently low-resistance and reliable soldered connection between the contact piece and the contact side of the strip conductor can be created more easily. A further feeding of current from an external circuit to the contact pieces is also simplified, since the contact pieces themselves on the freely accessible sides of the coil winding can be connected more easily to an external power supply.

The strip conductor may have two conductor surfaces, and the coil device may comprise at least two packing blocks, which are arranged respectively adjacent one of the conductor surfaces of the strip conductor in the torsion region of the at least one twisted turn, so that the packing blocks largely fill interspaces between adjacent turns that are caused by the torsion. The advantage of this embodiment is that the mechanical stability of the resultant coil winding is increased since the strip conductor is securely held by the at least two packing blocks. On the one hand, the mechanical stability during the winding of the coil is increased, so that a greater winding tension can be used during production without damaging the strip conductor in the region of the torsion zone. On the other hand, the mechanical stability during operation of the superconducting coil is also improved by the packing blocks. While they are in operation, superconducting coils may be exposed to strong centrifugal forces, for example due to the rotation in generators or machines. Alternatively or in addition, they may also be exposed to high Lorentz forces during the generation of strong magnetic fields. To protect the strip conductor from being damaged under such loads, it is expedient to securely hold the strip conductor on both sides, even in the torsion region of the winding, and protect it from unnecessary tensile or shearing forces and vibrations. The use of two separate packing blocks is therefore expedient, since the twisted strip conductor itself divides the cavity in the coil winding that is produced by the torsion into two approximately equally sized, non-contiguous parts.

Each of the two aforementioned packing blocks may comprise an inner and an outer section, the respective inner section being arranged on a side of the twisted strip conductor that is locally facing the center and the respective outer section being arranged on a side of the twisted strip conductor that is locally facing away from the center. Such a division of the packing blocks into at least two sections in each case is advantageous, since the torsion has the effect that the two conductive surfaces of the strip conductor respectively change over from lying on the inside to lying on the outside, or vice versa. Since it is difficult during the production of the winding to position an elongate packing block simultaneously above and below the winding of a strip conductor, the division of each packing block into at least two sections facilitates the insertion into the winding to be produced.

The torsion region of the winding may be at least three times as great as the width of the strip conductor along a local longitudinal direction of the strip conductor. Particularly advantageously, the torsion region may be at least five times and at most ten times as great as the width of the strip conductor in this direction. With a smaller aspect ratio of the torsion zone, the torsion of the strip conductor is narrower, and the individual layers of the strip conductor are subjected to greater mechanical loading by the torsion. The advantage of a rather small aspect ratio is, however, that the compactness and possibly existing symmetry of the overall coil device is only disturbed in a small partial region. It is therefore advantageous to choose the torsion zone to be as small as possible, given the mechanical load-bearing capacity of the strip conductor used. In the case of an embodiment with packing blocks, the aspect ratio of the dimensions of the packing block in the longitudinal direction of the strip conductor and in the direction of the conductor width is then approximately similarly great or almost as great as the aforementioned aspect ratio of the torsion region itself.

The coil winding may comprise at least five turns, and the at least one twisted turn may lie in the region of the 20% of the turns that are facing away from the center. For applications in electrical machines, generators and/or magnetic coils, the number of turns will advantageously be much higher, for example in the range of 10 to 1000 turns. For all of these applications it is advantageous if the turn affected by the torsion of the strip conductor lies rather in the outer region of the coil device. Since the coil is typically wound from the inside outward on an inner-lying winding support, it is favorable if the symmetry of the coil winding is not disturbed until later during production. Consequently, a large part of the coil winding can retain a usually advantageous symmetrical structure that is only disturbed by the torsion on a small partial region on the outer side of the winding. Alternatively, it may, however, also be advantageous in some cases if the conductor region affected by the torsion lies in the inner region of the coil arrangement.

The torsion region of the twisted turn may lie approximately diametrically opposite the region of the first contact. This is advantageous in order to distribute the asymmetry of the coil winding that is created by the first contact and the torsion zone uniformly over the winding.

The coil winding may be formed as a planar rectangular coil with four straight portions and four rounded corners. Such a rectangular coil or form of coil also known as a racetrack coil is often used in the area of rotors of generators or synchronous machines. In general, however, other forms of coil are also possible, such as for example oval or cylindrical flat coils or else saddle-shaped coils.

In the case of a rectangular coil winding, the torsion region may be arranged centrally on one of the straight portions of the rectangular coil. This arrangement has the advantage that the strip conductor is then only twisted along the longitudinal axis in the torsion region and is not at the same time bent within the winding plane at this location. If there is a torsion and at the same time a bending about a further axis at the same location, the strip conductor is subjected to greater loading than in the case of a simple torsion on a straight portion of the winding. Advantageous for the uniform distribution of the torsional stress is an arrangement of the torsion region in the middle of one of the straight portions of the rectangular coil. In the case of a coil that is intended for a rotating application, the torsion region is arranged particularly advantageously on or near the intended axis of rotation of the coil. Such a configuration has the advantage that, as a result of the positioning on or near the axis of rotation, only low centrifugal forces occur in the region of the torsion zone, and that consequently the mechanically rather more susceptible twisted region of the strip conductor is protected from additional mechanical loads.

The turns of the coil winding may be mechanically fixed with a casting compound and/or an adhesive. The resultant advantages are analogous to the advantages of the use of packing blocks for filling the cavities created by the torsion. In particular, the coil winding is protected from being damaged by effects of mechanical force.

The packing blocks may be used in combination with a casting of the coil winding, the inserted casting block also being cast together with the adjacent strip conductor turns.

Advantageous refinements and developments of the production method according to the invention are provided by the claims that are dependent on claim 10. Thus, a first contact between the contact side of the strip conductor and an inner contact piece may be formed before the winding of the strip conductor, and a second contact between the contact side of the strip conductor and an outer contact piece may be formed after the winding of the strip conductor. The forming of the inner contact before the winding of the coil winding has the advantage that the coil does not have to be released once again from the winding support for the forming of this inner contact. Given a suitable choice of the winding support, the coil may even remain on this winding support during its operation. When the coil is being wound up onto the already produced inner contact, the winding tension can also advantageously increase the mechanical strength of the connection to the inner contact.

Alternatively, a first contact between the contact side of the strip conductor and an inner contact piece and a second contact between the contact side of the strip conductor and an outer contact piece may only be formed after the winding of the strip conductor. This embodiment is advantageous if the coil is to be released from the winding support before it is put into operation, and either is used as a self-supporting component without a support or is transferred to a separate coil support for operation.

In the torsion region of the at least one twisted turn, at least two packing blocks may be arranged respectively adjacent one of two conductor surfaces of the strip conductor in such a way that they fill interspaces between adjacent turns that are caused by the torsion. The advantages of this refinement are analogous to the advantages of claim 4.

Each of the two packing blocks may comprise an inner section and an outer section, the respectively inner section being arranged on a side of the twisted strip conductor that is locally facing the center and the respectively outer section being arranged on a side of the twisted strip conductor that is locally facing away from the center. The advantage of such a segmentation of the packing blocks lies in the easier introduction of the sections during the winding of the coil, since the altogether at least two individual sections can be introduced during the gradual torsion and during the progressive winding of the twisted turn into the interspaces only then being created one after the other.

The coil winding may be adhesively bonded with a casting compound and/or with an adhesive after the winding and/or during the winding. The advantages of these embodiments are analogous to the advantages of claim 9.

FIG. 1 shows a cross section of a superconducting strip conductor 1, in which the layer structure is schematically represented. In this example, the strip conductor comprises a substrate strip 2, which here is a 100 μm thick substrate strip of a nickel-tungsten alloy. Alternatively, steel strips or strips of an alloy, such as for example Hastelloy, can also be used. Arranged over the substrate strip is a 0.5 μm thick buffer layer 4, which here contains the oxidic materials $CeO_2$ and $Y_2O_3$. Following on top of that is the actual superconducting layer 6, here a 1 μm thick layer of $YBa_2Cu_3O_x$, which in turn is covered with a 50 μm thick contact layer 8 of copper. Between the superconducting layer and the copper there may additionally be a top layer of silver. As an alternative to the material $YBa_2Cu_3O_x$, the corresponding compounds $REBa_2Cu_3O_x$ of other rare earths RE may also be used. Arranged on the opposite side of the substrate strip here is a further 50 μm thick top layer 10 of copper, followed by an insulator 12, which in this example is formed as a 25 μm thick Kapton tape. The insulator 12 may, however, also be made up of other insulating materials, such as for example other plastics. In the example shown, the width of the insulator 12 is somewhat greater than the width of the other layers of the strip conductor 1, so that turns that come to lie one on top of the other during the winding of the coil device are reliably insulated from one another. As an alternative to the example shown, it is possible only to wind an insulating strip into the coil device as a separate strip during the production of the coil winding. This is particularly advantageous if multiple strip conductors that do not have to be insulated from one another are wound in parallel. Then, for example, a stack of 2 to 10 strip conductors lying one on top of the other without an insulator layer may be wound together with an additionally placed-in insulator strip in one and the same turns.

Contacting of the strip conductor 1 is advantageously possible by way of the contact layer 8. The side of the strip conductor 1 that is lying on top in FIG. 1 is therefore also referred to as the contact side 13.

As an alternative to the structure of the strip conductor 1 that is shown in FIG. 1, however, other layer systems are also possible, in particular those in which the strip conductor 1 is provided with a contact layer 8 on both sides. Also in the case of such strip conductors 1 that are enclosed on both sides, however, there is a preferred contact side 13, which is typically the side of the substrate 2 on which the superconducting layer 6 is arranged.

Figure 2:
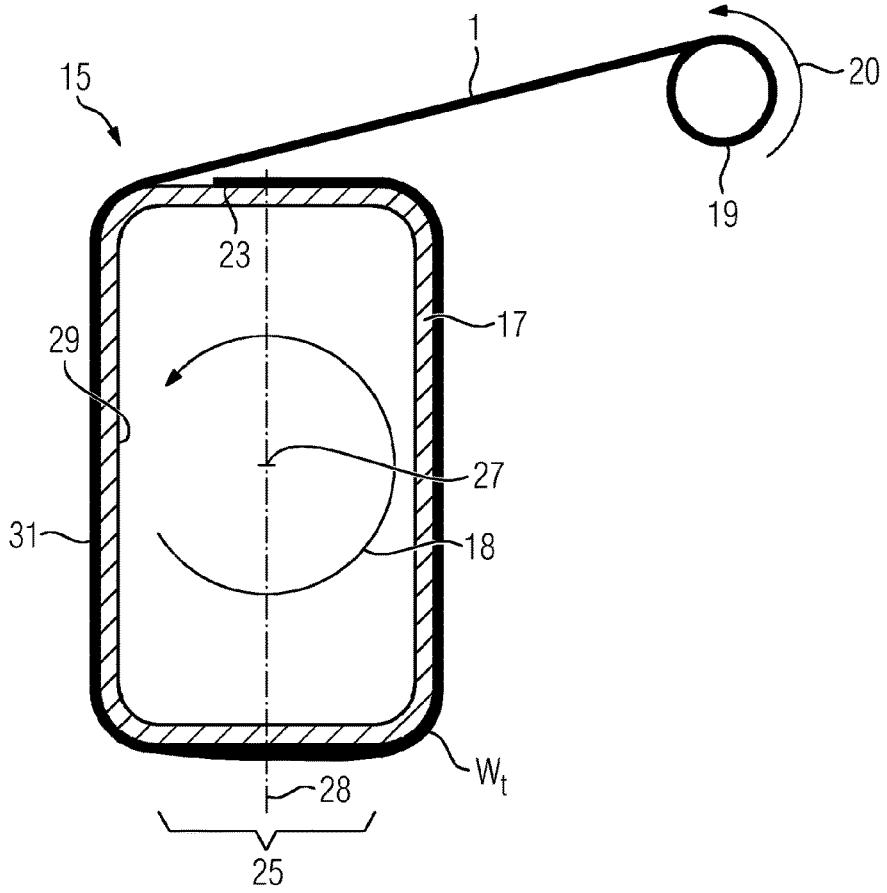
FIG. 2 shows a schematic cross section of a rectangular coil winding.

In FIG. 2, a schematic cross section of a rectangular coil winding 15 according to the preferred exemplary embodiment of the invention is shown. Shown is an early stage during the production of the coil winding 15, in which the strip conductor 1 is being wound up from a stock reel 19 onto a winding support 17. In this case, both the stock reel 19 and the winding support 17 are rotated within the winding plane, which here is the sectional plane, with the directions of rotation 18 and 20 that are marked in FIG. 1. At the beginning of the production of the coil winding 15, a first contact 23 was formed between the contact side 13 of the strip conductor and a first contact piece, which is not shown here for the sake of overall clarity. The first contact piece may consist for example substantially of copper and may be securely connected to the winding support 17 and/or be integrated in it. In this example, the winding support 17 is a cylindrical body with a rectangular cross section with rounded corners. The strip conductor 1 is then initially wound up with the inner-lying contact side 13 flat onto the winding support 17. In doing so, some turns with an initially inner-lying contact side 13 can be formed. In FIG. 2, only half a turn with an inner-lying contact side 13 is schematically shown, but this should be understood as being just by way of example. Coil windings 15 with a plurality of turns in which the contact side 13 lies on an inner side 29 of the coil winding 15 are advantageously produced. Then, within a turn $W_t$, which in FIG. 2 is the only turn shown for reasons of overall clarity, the strip conductor 1 is twisted about its local longitudinal axis 24 by approximately 180 degrees, so that after the torsion the contact side 13 of the strip conductor 1 comes to lie on an outer side 31 of the coil winding 15. In this exemplary embodiment, the torsion region 25 is arranged in such a way that it comes to lie completely on one of the straight portions of the rectangular coil. In this example, the length 26 of the torsion zone 25 is five times the width 30 of the strip conductor 1, so that the twisting of the strip conductor 1 does not lead to excessive mechanical loading of the layer system, but the torsion region 25 is also not extended any more than is necessary. Also marked in FIG. 2 is the axis of rotation 28, about which the finished coil winding 15 will rotate in a later application, for example in the rotor of a synchronous machine. In this example, the torsion region 25 is arranged symmetrically about this axis of rotation 28, so that loading of this sensitive region by centrifugal forces is minimized to a great extent. During the twisting of the strip conductor about its local longitudinal axis 24, two packing blocks with two sections 33 in each case, which mechanically support the twisted strip conductor, are introduced into the cavities created. The altogether four sections 33 are shaped in such a way that they fill the interspaces between the twisted turn $W_t$ and adjacent turns. The four sections 33 may for example fill an approximately equal volume and be designed in such a way that each packing block comprises an under-lying section and an upper-lying section. Of these, an under-lying section 33 and an upper-lying section 33 is respectively arranged adjacent the contact side 13 of the twisted turn $W_t$; the other two sections 33 are correspondingly arranged adjacent the rear side of the twisted strip conductor 1.

After the stage shown in FIG. 2, a number of further turns with an outer-lying contact side 13 may also be produced before a second contact with an outer contact piece is produced on the outer side 31 of the winding and the coil is subsequently cast with a casting compound or adhesively bonded with an adhesive.

Figure 3:
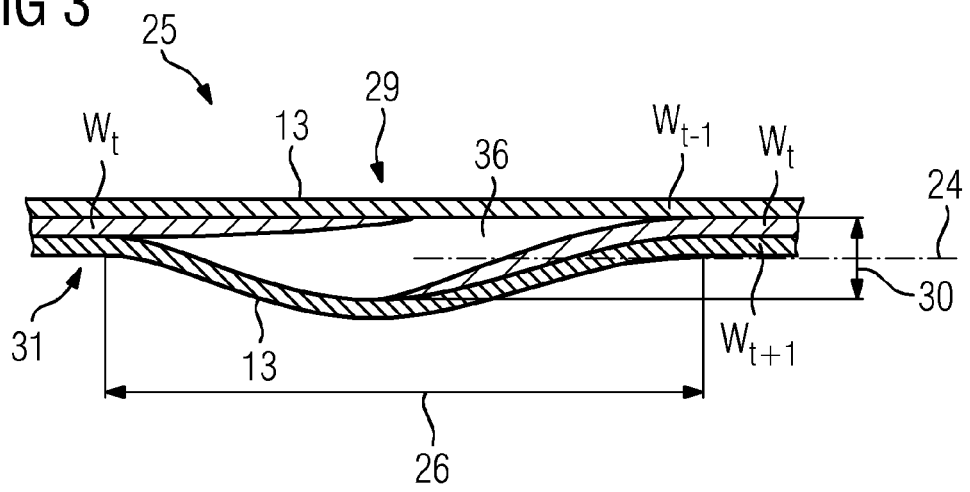
FIG. 3 shows a schematic view of a detail of the cross section of the torsion zone of the coil winding.

FIG. 3 shows a schematic view of a detail of the torsion region 25 of the coil winding 15. In this view of a detail, two turns $W_{t-1}$ and $W_{t+1}$ adjacent the twisted turn $W_t$ are then also shown. The upper region of FIG. 3 is in this case facing the inner side 29 of the coil winding 15, and the lower region is facing the outer side 31 of the coil winding 15. In the case of the turn $W_{t-1}$ and all of the turns lying further inward, the contact side 13 of the strip conductor 1 is facing the center 27 of the coil. In the case of the turn $W_{t+1}$ and all of the turns lying further outward, the contact side 13 of the strip conductor is facing away from the center 27 of the coil. On a portion of the length 26 of the turn $W_t$, the strip conductor 1 is twisted by approximately 180 degrees about its longitudinal axis 24. As a result, the thickness of this turn $W_t$ increases locally to a value that corresponds to the width 30 of the strip conductor. The packing blocks placed in above and below the twisted strip conductor 1 are not shown in FIG. 3 for the sake of overall clarity, since they would otherwise cover the conductor surface 36 of the twisted strip conductor 1. The conductor surface 36 shown may be for example the contact side 13.

Figure 4:
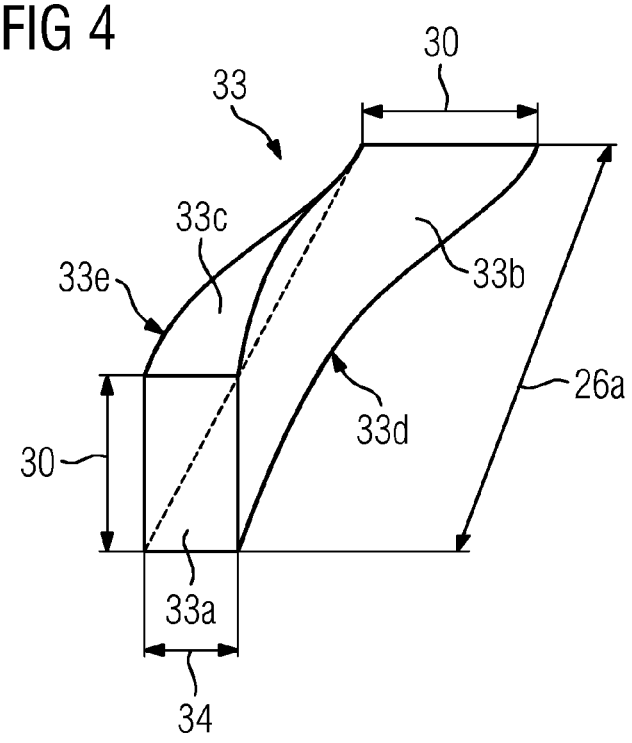
FIG. 4 shows a schematic perspective representation of a section of a packing block.

FIG. 4 shows a schematic perspective view of one of the four sections 33 of the packing blocks. The length of this section corresponds approximately to half the torsion length 26*a*. The section 33 shown comprises five delimiting faces 33*a* to 33*e*, two of which are curved faces 33*b*, 33*c* and three of which are planar faces 33*a*, 33*d*, 33*e*. In this example this is an under-lying section 33, which is inserted between the twisted turn $W_t$ and the next inner-lying turn $W_{t-1}$. The second associated section, which lies next to the same conductor surface 36 of the twisted strip conductor 1, is correspondingly an upper-lying section, which is inserted between the twisted turn $W_t$ and the outer-lying turn $W_{t+1}$ that is adjacent after the torsion. The straight delimiting face 33*a* connects these two sections that belong together. The twisted delimiting face 33*b* is adjacent the twisted conductor surface 36 of the turn $W_t$ in the finished wound coil. The likewise curved delimiting face 33*c* lies against the strip conductor 1 of the following turn $W_{t+1}$, which is formed as slightly convex because of the greater space requirement in the torsion region 25. By contrast, the delimiting face 33*d* arranged at the bottom in FIG. 4 is formed as straight and is arranged adjacent the next inner-lying turn $W_{t-1}$. The delimiting face 33*e* is finally likewise straight and delimits the section laterally, in a direction perpendicular to the winding plane.

In the preferred exemplary embodiment, the packing blocks are produced from glass-fiber-reinforced plastic. However, they may alternatively or additionally also comprise other materials. Particularly suitable are those materials of which the thermal shrinkage when the coil winding 15 is cooling down from room temperature to an operating temperature, of for example 77 K or 25-30 K, is similar in magnitude to the thermal shrinkage of the remaining coil winding 15.

What is claimed is:

1. A superconducting coil device comprising:

a coil winding comprising a superconducting strip conductor having a plurality of turns, the superconducting strip conductor having a contact side with a contact layer defining a first conductor surface, wherein, in a particular turn, the strip conductor is twisted in a torsion region of the particular turn by 180 degrees about a longitudinal axis of the strip conductor, to thereby define a twisted turn of the winding, and wherein, in an inner turn of the winding, the contact side of the strip conductor faces a center of the winding, and in an outer turn of the winding located radially outward from the inner turn, the contact side of the strip faces away from the center of the winding, wherein the torsion region of the particular turn is arranged between flat turns in an inner side and an outer side of the particular turn.

2. The superconducting coil device of claim 1, comprising: an inner conductive contact element arranged adjacent an inner side of the coil winding and conductively coupled to the contact side of the strip conductor at the inner turn of the winding, wherein such coupling defines a first contact point; and an outer conductive contact element arranged adjacent an outer side of the coil winding and conductively coupled to the contact side of the strip conductor at the outer turn of the winding, wherein such coupling defines a second contact point.

3. The superconducting coil device of claim 1, wherein: the torsion region of the winding includes interspaces defined between the twisted turn and adjacent turns of the winding; the strip conductor defines two conductor surfaces; and the coil device comprises at least two packing blocks, each arranged adjacent one of the conductor surfaces of the strip conductor in the torsion region of the twisted turn, such that the at least two packing blocks are arranged in the interspaces defined in the torsion region of the winding.

4. The superconducting coil device of claim 3, wherein each packing block comprises an inner arranged on a side of the twisted strip conductor locally facing the center of the winding and an outer section arranged on a side of the twisted strip conductor locally facing away from the center of the winding.

5. The superconducting coil device of claim 1, wherein a length of the torsion region along a longitudinal direction of the twisted turn of the strip conductor is at least three times as great as a width of the strip conductor.

6. The superconducting coil device of claim 2, wherein the torsion region of the twisted turn is located at an opposite side of the winding support from the first contact point.

7. The superconducting coil device of claim 1, wherein the coil winding is formed as a planar rectangular coil having four straight portions and four rounded corners.

8. The superconducting coil device of claim 7, wherein the torsion region is arranged centrally on one of the straight portions of the rectangular coil.

9. The superconducting coil device of claim 1, wherein the turns of the coil winding are mechanically fixed with at least one of a casting compound and an adhesive.

10. The superconducting coil device of claim 1, wherein the twisted turn is located radially between the inner turn and the outer turn.

11. The superconducting coil device of claim 1, wherein the coil winding includes multiple twisted turns.

* * * * *